US005411455A

United States Patent [19]

Haber et al.

[11] Patent Number: 5,411,455

[45] Date of Patent: May 2, 1995

[54] USER PROPELLED TREADMILL

[76] Inventors: Terry M. Haber, 25011 Castlewood, El Toro, Calif. 92630; William H. Smedley, 33285 Blanche Dr., Lake Elsinore, Calif. 92330; Clark B. Foster, 23631 Wakefield Ct., Laguna Niguel, Calif. 92677

[21] Appl. No.: 210,679

[22] Filed: Mar. 18, 1994

[51] Int. Cl.[6] ..... A63B 22/02

[52] U.S. Cl. ..... 482/54; 482/51

[58] Field of Search ..... 482/54, 52, 53, 37, 482/70, 51

[56] References Cited

U.S. PATENT DOCUMENTS 4,960,276 10/1990 Feuer et al. ..... 482/70

FOREIGN PATENT DOCUMENTS 0966865 4/1975 Canada ..... 482/54

*Primary Examiner*—Richard J. Apley
*Assistant Examiner*—Lynne A. Reichard
*Attorney, Agent, or Firm*—Hawes & Fischer

[57] ABSTRACT

A relatively low cost, lightweight user propelled treadmill that provides the user with a full body workout. The treadmill includes a housing which supports a tread for rotation around front and rear rotatable drums. Extending upwardly from the housing are a pair of user actuated handlebars which are adapted for back and forth movement relative to the housing. The handlebars are coupled to the front rotatable drum by a one way clutch so that the movement of the handlebars generated by the user is translated into a corresponding movement of the tread without the assistance of an electric motor. The one way clutch is located within the front rotating drum so as to be able to grasp and rotate the drum in the same direction as the clutch whenever the clutch is rotated in a particular direction.

20 Claims, 4 Drawing Sheets

USER PROPELLED TREADMILL

BACKGROUND OF THE INVENTION

1. Field of the Invention

This invention relates to a relatively low cost, lightweight and fully self-propelled treadmill by which the push-pull movement of the handlebars generated by the user is translated into a corresponding rotational movement of the tread without requiring the assistance of an electric motor, or the like.

2. Background Art

Treadmills have long been used in the office, home or gym by exercise enthusiasts as a means to keep physically fit. However, the treads of many treadmills are driven by an electric motor. As a result, the treadmill must be operated near a suitable source of electric power which may prove to be an inconvenience. The presence of an electric motor also increases the weight and complexity of the treadmill so as to make it relatively difficult for the treadmill to be easily transported and used. Likewise, the electric motor will cause a corresponding increase in cost.

In other treadmills, the tread is driven entirely by the leg motion of the user. In this case (as well as in the case of the aforementioned electric motor driven treadmill), the handlebars provide little, if any, exercise function. That is to say, the handlebars are typically fixed in place and serve as a means of support, only. Consequently, one who exercises with a conventional treadmill, as described above, will do little to improve his upper body, particularly his arms, by merely holding onto the handlebars.

It would therefore be desirable to provide a self-propelled treadmill that functions as a full body exercise apparatus which is characterized by a relatively low cost and light weight and the ability to be used at virtually all indoor and outdoor locations without regard to the availability of an electric power source.

SUMMARY OF THE INVENTION

A relatively low cost, lightweight user propeller treadmill is disclosed that provides the user with a full body workout. The treadmill includes a housing which supports a tread for rotation around front and rear rotatable drums. Extending upwardly from the housing are a pair of user actuated handlebars which are adapted for back and forth movement in response to pushing and pulling forces applied thereto. The handlebars are coupled to the tread by means of a one-way clutch so that the movement of the handlebars generated by the user is translated into a corresponding movement of the tread without the assistance of an electric motor. An optional control panel is positioned above the treadmill by a support column. The control panel includes a series of user initiated controls and output displays to provide the user with information concerning his performance on the treadmill.

The one-way clutch is located within one of the tread supporting drums at the front of the treadmill housing. The clutch is of the type having a number of ramped pockets spaced evenly therearound and a corresponding number of needle clutch bearings located within respective pockets. As the clutch is rotated in a particular direction, the needle clutch bearings are forced to move in an opposite direction in their respective pockets so as to ride up ramped surfaces thereof at which to exert a frictional pulling force on the drum within which the one-way clutch is located. Accordingly, the front drum and the tread supported thereby are rotated in the same direction as the clutch.

A rotatable shaft extends through the one-way clutch and outwardly from opposite ends of the front drum in which the clutch is located for receipt at opposite sides of the treadmill housing. Each end of the shaft is coupled to an inertia wheel and a spur gear. The spur gears at the ends of the shaft are received for rotation by respective gear racks that are connected to the opposing handlebars of the treadmill so as to be movable therewith for causing a corresponding rotation of the spur gears. Accordingly, when the handlebars are pulled towards the user during use, the spur gears will rotate the shaft and the clutch carried thereon, whereby to also cause a rotation of the front drum and the tread supported thereby.

DETAILED DESCRIPTION

Figure 1:
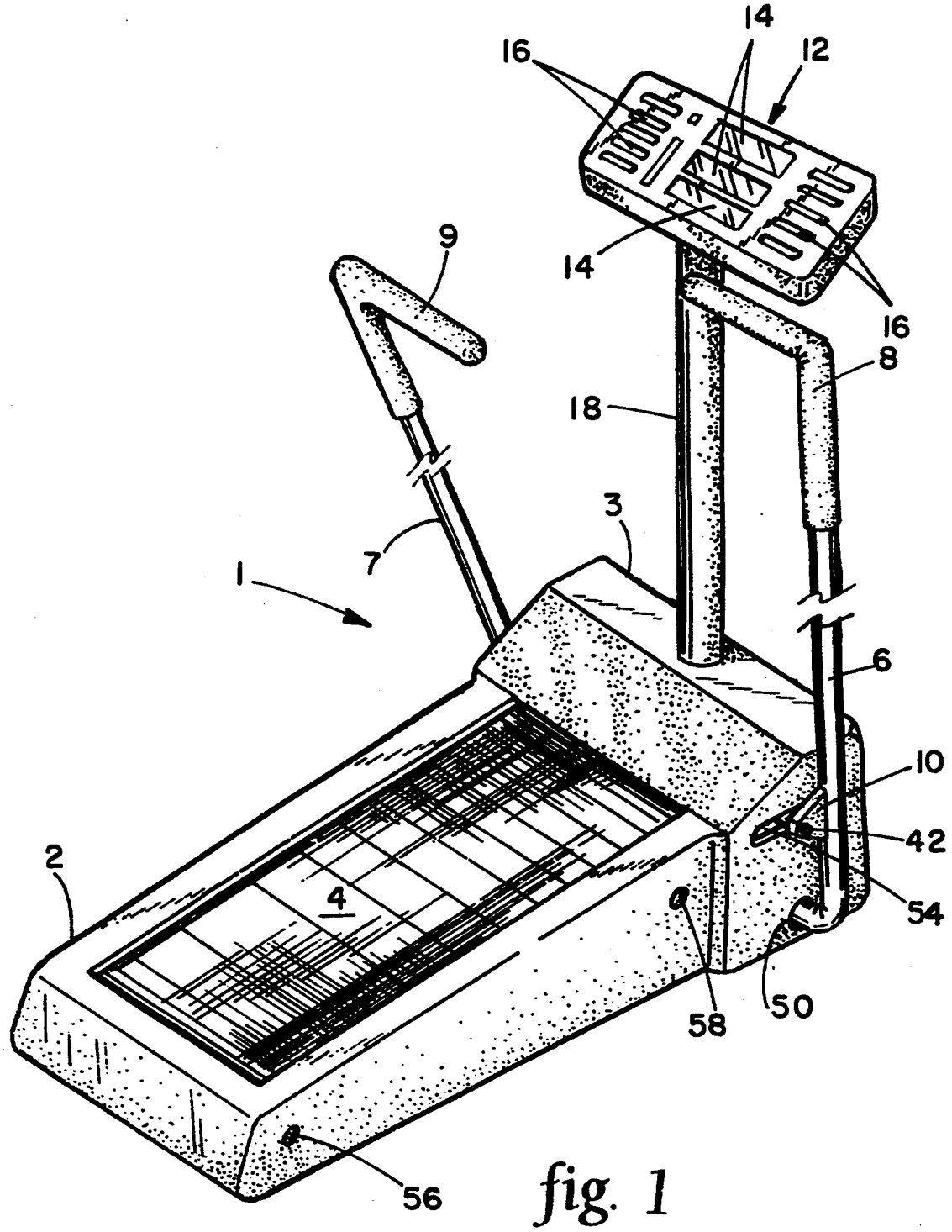
FIG. 1 is a perspective view of the user propelled treadmill which forms the present invention.

The present invention is described in detail while initially referring to FIG. 1 of the drawings, where a user propelled treadmill 1 is shown including an elongated housing 2 and a tread 4. As in conventional treadmills, the tread 4 of treadmill 1 of this invention is supported for rotational movement relative to the housing 2. The housing 2 may be made from lightweight, impact resistant plastic, and the tread 4 may be made from a friction inducting material, such as rubber. However, it is to be understood that the materials used to manufacture the housing 2 and the tread 4 of treadmill are not to be considered limitations of the present invention.

Figure 2:
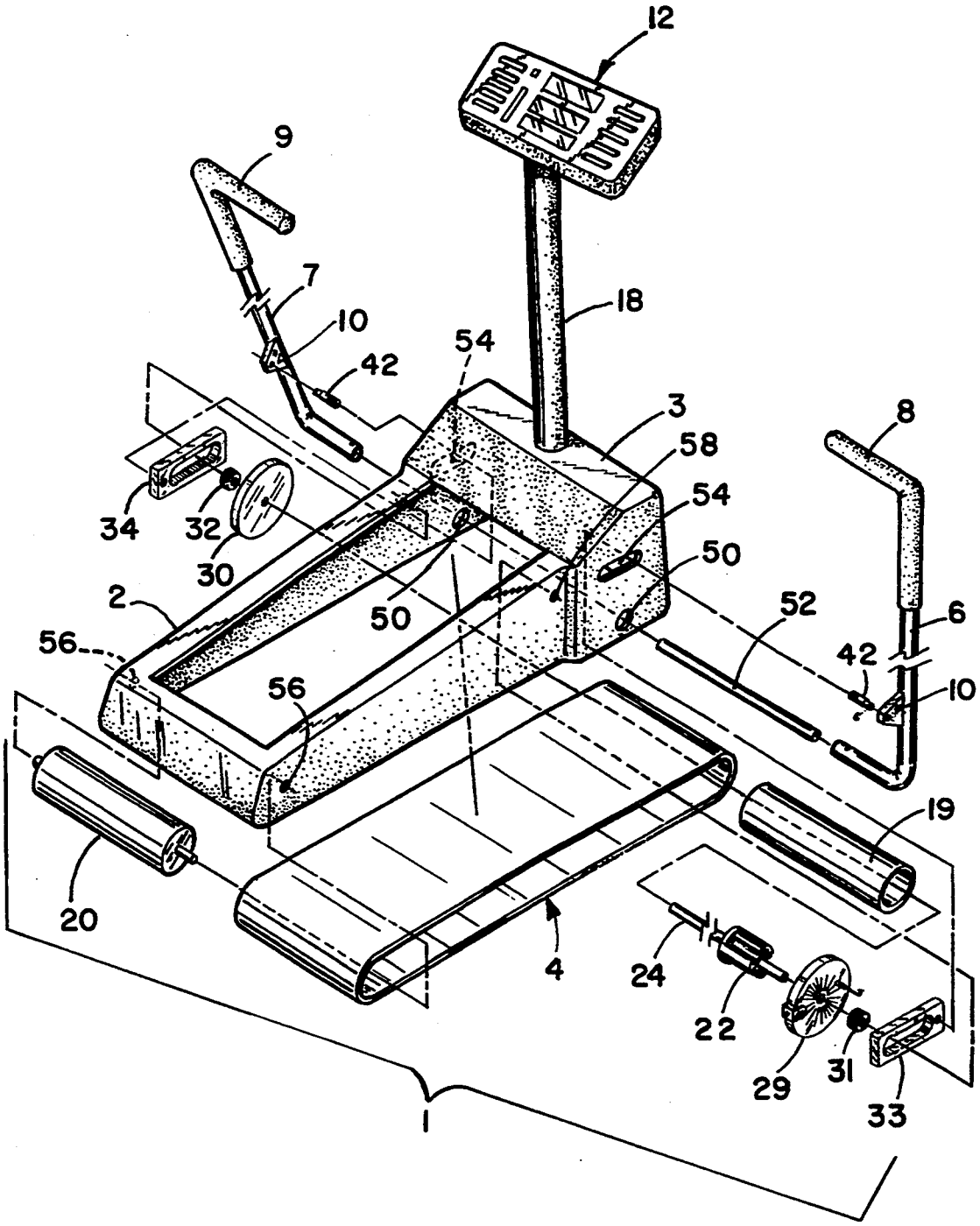
FIG. 2 is an exploded view of the treadmill of FIG. 1.

Extending upwardly from the forward end 3 of housing 2 are a pair of opposing handlebars 6 and 7. As is best shown in FIG. 2, lower ends of the handlebars 6 and 7 are coupled to one another through openings 50 formed in opposite sides of the housing 2 by means of a linking bar 52 which extends laterally through housing 2. The handlebars 6 and 7 are supported by housing 2 for back and forth movements. The upper ends of handlebars 6 and 7 terminate at respective handles 8 and 9, each of which having a suitable gripping surface for the convenience of the user. Each handlebar 6 and 7 has a connector bracket 10 affixed thereto by which to permit the handlebars to be coupled to a clutch assembly (best shown in FIG. 3) at the interior of the housing 2 by way of slots 54 through opposite sides thereof so as to enable the arm motion of the user applied to handlebars 6 and 7 to be translated into a rotational movement of the tread 4.

Also extending upwardly from the forward end 3 of housing 2 of treadmill 1 is an optional control panel 12. The control panel 12 has a plurality of visual displays 14 which provide useful information (e.g. equivalent distance traveled, calories consumed, elapsed time, etc.) concerning the performance of the user on the treadmill. Similarly, the control panel 12 includes a plurality of user initiated controls 16 by which the user is able to selectively adjust the operation of the treadmill 1. The control panel 12 is supported above the treadmill 1 by means of a hollow support column 18, and the displays 14 and controls 16 of panel 12 communicate with the clutch assembly of FIG. 3 via column 18.

FIG. 2 of the drawings shows a clutch assembly of treadmill 1 to convert the arm motion applied by the user to the handlebars 6 and 7 into a corresponding rotation of the tread 4 relative to the housing 2. The tread 4 has a belt loop configuration and is carried by front and back rotatable drums 19 and 20 that are located at the corresponding front and back ends of the belt loop. The rear drum 20 has a solid cross-section and an axle that is supported for rotation at holes 56 formed through opposite sides of the housing 2. The front drum 19 is hollow in order to receive therewithin a one-way clutch 22 of the clutch assembly.

Figure 3:
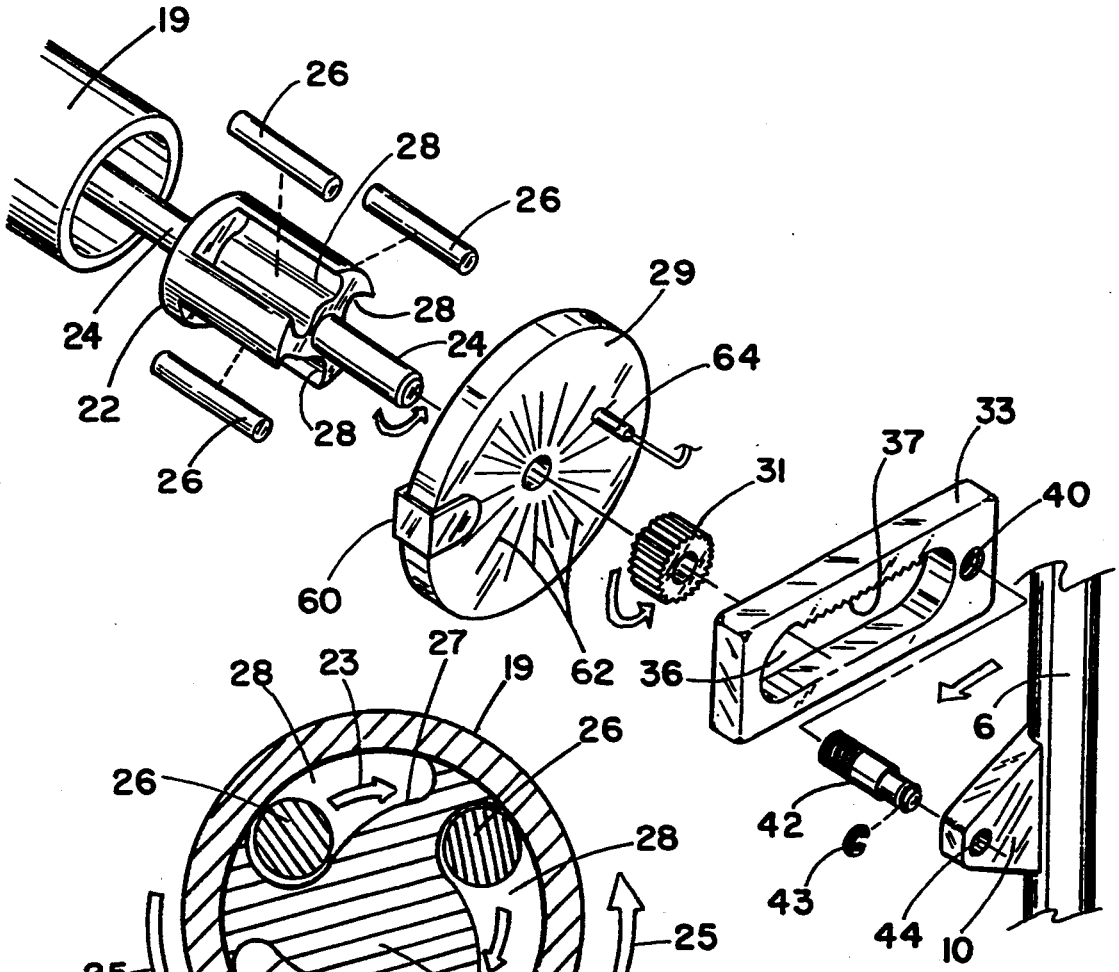
FIG. 3 is an exploded view showing one end of a clutch assembly of the treadmill by which the movement of the handlebars is translated into a corresponding rotational movement of the tread.
Figure 4:
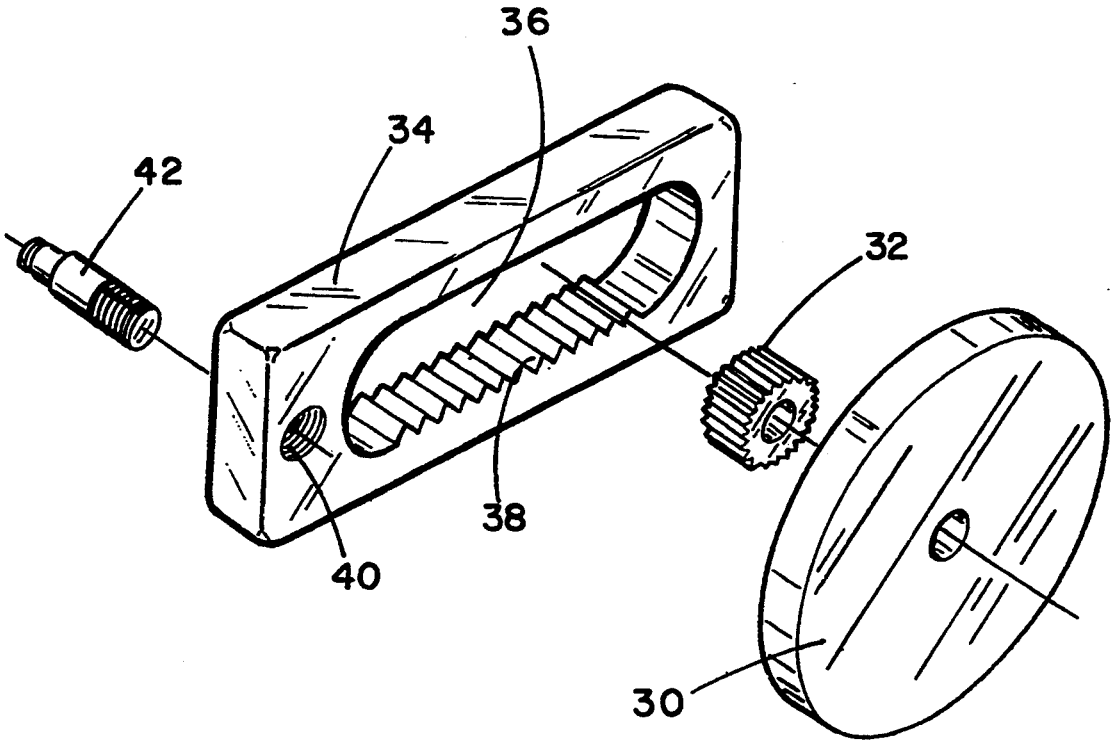
FIG. 4 is an exploded view showing the opposite end of the clutch assembly illustrated in FIG. 3.

More particularly, and referring concurrently to FIGS. 2–4 of the drawings, the one-way clutch 22 is of conventional design and includes a longitudinally extending shaft 24 and a plurality of (e.g. three) needle clutch bearings 26 that are seated within a corresponding plurality of pockets 28 that are spaced evenly around the clutch 22. An inertia wheel 29 and 30 is affixed to each end of the shaft 24 which projects outwardly from the front drum 19 within which the clutch 22 is disposed. The opposite ends of the shaft 24 are supported for rotation at holes 58 formed through opposite sides of the housing 2. Similarly, a spur gear 31 and 32 is also affixed to each end of shaft 24 after the inertia wheels 29 and 30. The spur gears 31 and 32 are mated to respective toothed gear racks 33 and 34.

Each gear rack 33 and 34 includes a generally oval-shaped central opening 36 having a row of teeth 37 and 38 extending therealong to mate with the teeth of a respective spur gear 31 and 32. As an important detail of the treadmill 1 of this invention, the gear rack 33 (shown in FIG. 3) has a row of teeth 37 projecting downwardly into the central opening 36 thereof to engage the teeth of the spur gear 31 affixed to one end of the shaft 24 of clutch 22, while the gear rack 34 (shown in FIG. 4) has a row of teeth 38 projecting upwardly into the central opening 36 thereof to engage the teeth of the spur gear 32 affixed to the opposite end of shaft 24. Moreover, in the atrest configuration of treadmill 1, the spur gear 31 will be initially located at one (e.g. the left) side of the central opening 36 in gear rack 33, and the spur gear 32 will be located at the opposite (e.g. right) side of the central opening 36 in gear rack 34.

Each of the gear racks 33 and 34 has a threaded hole 40 formed therethrough. The threaded holes 40 of gear racks 33 and 34 are adapted to receive threaded first ends of respective bolts 42. The opposite ends of the bolts 42 are pivotally received and retained (by means of fasteners 43) in holes 44 formed through the connector brackets 10 which are affixed to the opposing handlebars 6 and 7 of treadmill 1 (best shown in FIG. 3).

The operation of the one way clutch 22 of treadmill 1 for translating the movement of the handlebars 6 and 7 into a rotational movement of the tread 4 is now described while referring concurrently to FIGS. 1–5 of the drawings. As the user applies a pulling force to the handles 8 and 9, the handlebars 6 and 7 will be rotated slightly (in a counter clockwise direction) around bolts 42 and moved in a generally rearward direction towards the user. Being that the gear racks 33 and 34 are connected to be handlebars 6 and 7 at brackets 10, a movement of the handlebars 6 and 7 is transferred to the gear racks 33 and 34 and to the spur gears 31 and 32 in the respective central openings 36 thereof for causing each of the spur gears 31 and 32 to rotate in a counter clockwise direction. However, because the teeth 37 and 38 of gear racks 33 and 34 and the spur gears 31 and 32 in central openings 36 are disposed opposite one another, the gear racks 33 and 34 will move in opposite directions in response to the pulling force applied to handlebars 6 and 7.

Figure 5:
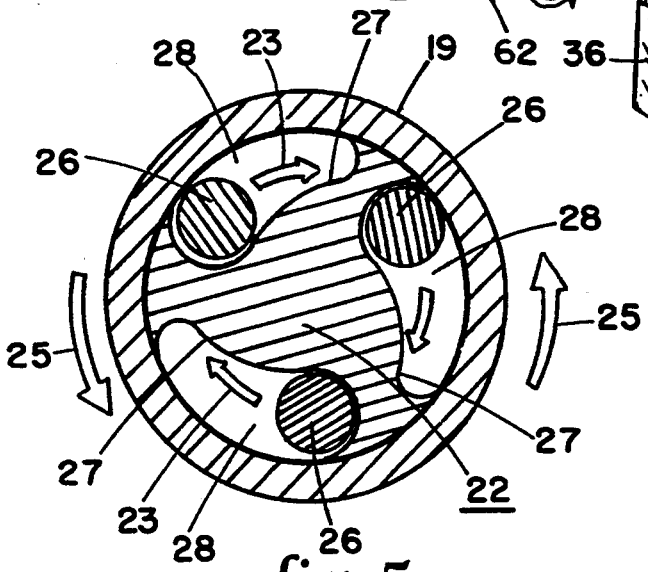
FIG. 5 is a cross-section of a one-way clutch of the clutch assembly illustrated in FIG. 3.

The counter clockwise rotation of the spur gears 31 and 32 is imparted to shaft 24, whereby to cause a corresponding counter clockwise rotation of the shaft 24 and the one-way clutch 22 carried thereby. Referring particularly now to FIG. 5 of the drawings, the counter clockwise rotation of clutch 22 causes the needle clutch bearings 26 to move in opposite clockwise directions (represented by the reference arrows 23) and ride up ramp surfaces 27 of respective pockets 28. As the bearings 26 ride up the ramp surfaces 27 of pockets 28, they will move into frictional engagement with and grab the inside of the front drum 19 within which the clutch 22 is located. Accordingly, so long as the handlebars 6 and 7 are pulled rearwardly and the one way clutch 22 rotates in the counter clockwise direction, the needle bearings 26 will exert a pulling force on the front drum 19 to cause the drum to rotate with clutch 22 in the counter clockwise direction (indicated by reference arrows 25). Since the tread 4 of treadmill 1 extends around and is supported by the front drum 19, the counter clockwise rotation of drum 19 causes a corresponding counter clockwise rotation of the tread 4 relative to the housing 2.

In this same regard, it may be appreciated that when the handlebars 6 and 7 of treadmill 1 are pushed in a forward direction away from the user, spur gears 31 and 32 will impart a clockwise rotation to the shaft 24 of one way clutch 22. Accordingly, the needle clutch bearings 26 will be driven away from the ramp surfaces 27 of pockets 28 so as to remain disengaged from the front drum 19. Therefore, pushing the handlebars 6 and 7 in the forward direction and rotating the one way clutch 22 in the clockwise direction will have no effect on the rotation of the front drum 19 and the tread 4 supported thereon. Nevertheless, and unlike conventional treadmills in which the handlebars remain idle and useless, the back and forth pulling and pushing forces applied by the user to the handlebars 6 and 7 of treadmill 1 to rotate the tread 4 enables the user to obtain a full body workout.

The inertia wheels 29 and 30 are affixed to opposite ends of the clutch shaft 24 to increase the mass carried by the shaft and smooth the travel of the shaft. As is best shown in FIG. 3, at least one of the inertia wheels (e.g. 29) may have a caliper 60 coupled thereto to increase the friction (i.e. resistance) applied to wheel 29. That is, the user may adjust the setting of caliper 60 from the control panel 12 to select the pulling and pushing forces that must be applied to the handlebars 6 and 7 to cause the one way clutch 22 and the tread 4 to rotate.

What is more, and is also best shown in FIG. 3, the inertia wheel 29 may contain a series of calibration lines 62. By counting the number of calibration lines 62 moving past a reference point during a given time, an indication may be provided as to the speed in which the clutch 22 and the tread 4 coupled thereto are rotated by the user. To this end, an optical reader 64 that is sensitive to light and dark transitions may be mounted in spaced alignment with inertia wheel 29 so as to be sensitive to the movement of calibration lines 62 therepast as the wheel 29 rotates on the clutch shaft 24. The optical reader 64 is adapted to provide an output signal to one of the visual displays at the control panel 12 for providing an indication of the performance of the user on treadmill 1 depending upon the rotational speed of the inertia wheel 29.

It will be apparent that while a preferred embodiment of the invention has been shown and described, various modifications and changes may be made without departing from the true spirit and scope of the invention.

Having thus set forth the preferred embodiment, what is claimed is:

1. A treadmill comprising a housing, a tread supported for rotation relative to said housing, support means connected to said housing and adapted to be grasped by a user and moved in back and forth directions, a clutch assembly including a rotatable clutch to couple said support means to said tread so that at least one of the back and forth movements of said support means is translated into a corresponding rotation of said tread, and a hollow drum to support said tread for rotation relative to said housing, said rotatable clutch adapted to be coupled to said hollow drum, such that the rotation of said clutch is imparted to said drum for causing a corresponding rotation of said tread.

2. The treadmill recited in claim 1, wherein said support means are first and second handlebars respectively connected to opposite sides of said housing and movable in said back and forth directions relative thereto.

3. The treadmill recited in claim 1, wherein said rotatable clutch is located within said hollow drum.

4. The treadmill recited in claim 3, further said rotatable clutch has a plurality of upwardly sloping pockets spaced therearound and a corresponding plurality of needle clutch bearings located in and movable through respective ones of said pockets, a rotation of said clutch in a particular direction causing said needle clutch bearings to ride upwardly along their sloping pockets to engage said drum and thereby impart the rotation of said clutch to said drum for rotating said tread.

5. The treadmill recited in claim 3, wherein said rotatable clutch is carried on a shaft extending through said clutch and outwardly of said drum, each end of said shaft supported for rotation by respective opposite sides of said housing.

6. The treadmill recited in claim 5, said clutch assembly also including an inertia wheel secured to each end of said shaft to be rotated therewith.

7. The treadmill recited in claim 6, further comprising resistance generating means coupled to at least one of said inertia wheels and adapted to slow the rotational speed of said inertia wheel and said shaft to which said wheel is secured.

8. The treadmill recited in claim 6, further comprising calibrations marked on at least one of said inertia wheels and means for counting said calibrations as said inertia wheel is rotated with said shaft, the number of calibrations counted providing an indication of the rotational speed of each of said shaft, said clutch carried on said shaft and said tread coupled to said clutch.

9. The treadmill recited in claim 8, further comprising optical means for counting said calibrations as said at least one inertia wheel is rotated, said optical means providing an output signal that is indicative of the rotational speed of said tread depending upon the number of calibrations counted during a particular time interval.

10. The treadmill recited in claim 5, said clutch assembly also including a rotatable spur gear secured to each end of said shaft and first and second gear racks respectively connected to said first and second handlebars and movable therewith, each gear rack having an opening for receiving a spur gear for rotation therewithin, such that the movement of said gear racks in response to said back and forth movements of said handlebars causes a corresponding rotation of said spur gears and said clutch interconnected thereto by way of said shaft.

11. The treadmill recited in claim 10, wherein each of the openings in said gear racks has a series of teeth to be mated to a respective spur gear, the teeth of the first gear rack which is connected to a first of said handlebars extending along one side of the opening in said first gear rack, and the teeth of the second gear rack which is connected to the second of said handlebars extending along an opposite side of the opening in said second gear rack.

12. The treadmill recited in claim 11, wherein said first and second gear racks are pivotally connected to respective ones of said first and second handlebars, said first and second gear racks moving in opposite directions relative to one another in response to the back and forth movements of said handlebars and the rotation of said spur gears in respective openings of said gear racks.

13. The treadmill recited in claim 1, further comprising a control panel supported above said housing and having display means for providing a visual indication of the rotation of said tread.

14. A treadmill having a housing and comprising:

at least one hollow drum supported for rotation by said housing;

a tread extending around said drum to be rotated by said drum relative to said housing;

first and second handlebars adapted to be moved in back and forth directions relative to said housing; and a clutch assembly including a rotatable clutch located within said hollow drum to couple said handlebars to said drum so that at least one of said back and forth movements of said handlebars causes a rotation of said clutch which is translated into a rotation of said drum for causing a corresponding rotation of said tread.

15. The treadmill recited in claim 14, wherein said rotatable clutch is carried on and rotated by a rotatable shaft having first and opposite ends connected to respective ones of said first and second handlebars, such that the movement of said handlebars in the back and forth directions rotates said shaft and causes a rotation of said clutch.

16. A treadmill including a housing, a tread supported for rotation relative to said housing, first and second handlebars connected to said housing to be griped by a user and moved in back and forth directions, and means to couple said handlebars to the tread so that at least one of the back and forth movements of said handlebars is translated into a corresponding rotation of the tread, said means to couple said handlebars to the tread comprising:

a rotatable clutch coupled to the tread such that a rotation of said clutch is imparted to said tread;

a shaft having first and opposite ends thereof supported for rotation by said housing, said rotatable clutch carried by said shaft so that a rotation of said shaft causes a corresponding rotation of said clutch;

first and second rotatable spur gears respectively connected to said first and opposite ends of said shaft; and first and second gear racks respectively connected to said first and second handlebars and movable therewith, each of said gear racks having an opening for receiving respective ones of said first and second spur gears for rotation therewithin, such that the movement of said first and second gear racks in response to the back and forth movements of said handlebars causes a corresponding rotation of said first and second spur gears and said clutch by way of said shaft.

17. The treadmill recited in claim 16, further including a hollow drum supporting the tread for rotation, said rotatable clutch located inside said hollow drum and adapted to be coupled to said drum, such that a rotation of said clutch caused by a rotation of said shaft is imparted to said drum for rotating said drum and causing a corresponding rotation of the tread.

18. The treadmill recited in claim 17, wherein said rotatable clutch is a one way clutch that is coupled to said hollow drum to rotate said drum only when said clutch is rotated by said shaft in one particular direction.

19. The treadmill recited in claim 16, wherein each of the openings in said first and second gear racks has a series of teeth to be mated to a respective one of said first and second spur gears, the teeth of the first gear rack which is connected to the first of said handlebars extending along one side of the opening in said first gear rack, and the teeth of the second gear rack which is connected to the second of said handlebars extending along an opposite side of the opening in said second gear rack.

20. The treadmill recited in claim 16, wherein said first and second gear racks are pivotally connected to respective ones of said first and second handlebars, said first and second gear racks moving in opposite directions relative to one another in response to the back and forth movements of said handlebars and the rotation of said first and second spur gears in respective openings of said gear racks.

* * * * *